US010214010B2

(12) United States Patent
Misawa et al.

(10) Patent No.: US 10,214,010 B2
(45) Date of Patent: Feb. 26, 2019

(54) LIQUID DISCHARGE DEVICE AND INKJET PRINTER INCLUDING THE SAME

(71) Applicant: Roland DG Corporation, Hamamatsu-shi, Shizuoka (JP)

(72) Inventors: Keisuke Misawa, Hamamatsu (JP); Kenji Kazaoka, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/922,950

(22) Filed: Mar. 16, 2018

(65) Prior Publication Data

US 2018/0290445 A1 Oct. 11, 2018

(30) Foreign Application Priority Data

Apr. 5, 2017 (JP) ..... 2017-075040

(51) Int. Cl.
*B41J 29/38* (2006.01)
*B41J 2/045* (2006.01)

(52) U.S. Cl.
CPC ..... *B41J 2/04541* (2013.01); *B41J 2/04573* (2013.01); *B41J 2/04588* (2013.01)

(58) Field of Classification Search
USPC ..... 347/9, 10, 11
See application file for complete search history.

(56) References Cited

U.S. PATENT DOCUMENTS 6,488,349 B1 * 12/2002 Matsuo ..... B41J 2/04581 347/11
7,988,247 B2 * 8/2011 Letendre ..... B41J 2/04573 347/10
8,353,567 B1 1/2013 Banerjee et al.
2012/0306954 A1 * 12/2012 Nishikawa ..... B41J 2/04516 347/11
2014/0240384 A1 8/2014 Yokomaku

FOREIGN PATENT DOCUMENTS

JP 10-81012 A 3/1998
JP 2012-250477 A 12/2012
JP 2014-065149 A 4/2014
JP 2014-162221 A 9/2014
JP 2015-066852 A 4/2015

* cited by examiner

*Primary Examiner* — Lam Nguyen
(74) *Attorney, Agent, or Firm* — Keating & Bennett, LLP

(57) ABSTRACT

A driving signal generating circuit generates, for each driving period, a main driving signal including a first sub driving signal including a first driving pulse, a second sub driving signal including a second driving pulse, and a third sub driving signal including a third driving pulse. The third sub driving signal follows the second sub driving signal. A driving signal supplying circuit includes a second dot former to supply the second sub driving signal and the third sub driving signal to an actuator coupled to a defining plate defining a portion of a pressure chamber, without supplying the first sub driving signal to the actuator. The third driving pulse starts after a lapse of a preset time from the start of the second driving pulse. The preset time is equal to a value of about p×Tc, where p is greater than 2.

10 Claims, 7 Drawing Sheets

LIQUID DISCHARGE DEVICE AND INKJET PRINTER INCLUDING THE SAME

CROSS REFERENCE TO RELATED APPLICATIONS

This application claims the benefit of priority to Japanese Patent Application No. 2017-075040 filed on Apr. 5, 2017. The entire contents of this application are hereby incorporated herein by reference.

BACKGROUND OF THE INVENTION

1. Field of the Invention

The present invention relates to liquid discharge devices and inkjet printers including the liquid discharge devices.

2. Description of the Related Art

A liquid discharge device known in the related art includes: a pressure chamber storing a liquid; a defining plate defining a portion of the pressure chamber; an actuator coupled to the defining plate; a nozzle in communication with the pressure chamber; and a controller to supply a driving signal to the actuator so as to drive the actuator. Such a liquid discharge device is provided in, for example, an inkjet printer that discharges ink in the form of a liquid.

An inkjet printer including the liquid discharge device is configured such that application of a driving pulse signal (hereinafter referred to as a "driving pulse") to the actuator from the controller causes deformation of the actuator, and the defining plate deforms in accordance with the deformation of the actuator. This increases or reduces the capacity of the pressure chamber so as to change the pressure of the ink in the pressure chamber. The change in the pressure causes the ink to be discharged from the nozzle. The discharged ink becomes a droplet (i.e., an ink droplet), and the droplet flies off and hits a recording medium, such as recording paper. This results in formation of a single dot on the recording paper. Forming a large number of such dots on the recording paper provides an image, for example.

Adjusting the size (e.g., diameter) of each dot enables formation of a high quality image on the recording paper. The inkjet printer described above, however, has a limit to the amount of droplets that may be stably discharged using a single driving pulse. The use of only a single driving pulse makes it difficult to form dots of different sizes. JP 10-81012 A, for example, discloses a method for adjusting the size of each dot by a multi-dot system. The multi-dot system involves: generating a driving signal including a plurality of driving pulses within a time period preset for formation of a single dot on recording paper; and selectively supplying one or more driving pulses included in the driving signal to the actuator. The preset time period will hereinafter be referred to as a "driving period". For example, a relatively large dot is formed by discharging two or more droplets on a time-series basis within a single driving period, and merging the droplets before the droplets hit the recording paper.

Studies conducted by the inventors of preferred embodiments of the present invention reveal that there is room for further improvement when the technique described above is used for a business-grade wide-format printer, for example. A wide-format printer is required to form larger dots (e.g., dots each having an ink mass of 15 ng or more) at a higher printing speed than a printer for home use. When a relatively large dot is formed by discharging two or more droplets on a time-series basis within a single driving period, however, a time period between discharge of a first droplet and discharge of a second droplet must be set appropriately. Otherwise, the droplets will unfortunately be discharged unstably.

SUMMARY OF THE INVENTION

Accordingly, preferred embodiments of the present invention provide liquid discharge devices that stably discharge droplets with desired sizes. Preferred embodiments of the present invention also provide inkjet printers including the liquid discharge devices.

The inventors of preferred embodiments of the present invention have discovered that even when a time period between discharge of a first droplet and discharge of a second droplet is preset so as to enable stable droplet discharge, the timing of discharge of the second droplet may slightly vary due to the operating conditions of a liquid discharge device. Taking note of the fact that a change in the preset time period changes the discharge amount and discharge speed of the droplets discharged from a nozzle, the inventors have determined the range of the time period in which changes in the discharge amount and discharge speed of the droplets discharged from the nozzle are relatively small if the timing of discharge of the second droplet varies. Setting the time period within the determined range makes it possible to stably discharge droplets with desired sizes.

A liquid discharge device according to a preferred embodiment of the present invention includes a liquid discharge head and a controller. The liquid discharge head is structured to discharge a liquid. The controller is configured or programmed to control the liquid discharge head. The liquid discharge head includes a case, a defining plate, an actuator, and a nozzle. The case is provided with a pressure chamber storing the liquid therein. The defining plate is disposed in the case. The defining plate defines a portion of the pressure chamber. The actuator is coupled to the defining plate. The actuator is deformed upon receiving an electric signal. The nozzle is disposed in the case. The nozzle is in communication with the pressure chamber. The controller includes a driving signal generating circuit and a driving signal supplying circuit. The driving signal generating circuit generates, for each driving period, a main driving signal including a first sub driving signal, a second sub driving signal, and a third sub driving signal. The first sub driving signal includes a first driving pulse to cause the pressure chamber to expand and contract so as to discharge a first droplet. The second sub driving signal includes a second driving pulse to cause the pressure chamber to expand and contract so as to discharge a second droplet. The third sub driving signal includes a third driving pulse to cause the pressure chamber to expand and contract so as to discharge a third droplet. The third sub driving signal follows the second sub driving signal. The driving signal supplying circuit supplies, to the actuator, a portion or an entirety of the main driving signal generated by the driving signal generating circuit. The driving signal supplying circuit includes a first dot former, a second dot former, and a third dot former. The first dot former supplies the third sub driving signal to the actuator without supplying the first sub driving signal or the second sub driving signal to the actuator. The second dot former supplies the second sub driving signal and the third sub driving signal to the actuator without supplying the first sub driving signal to the actuator. The third dot former supplies the first sub driving signal, the second sub driving signal, and the third sub driving signal to the actuator. The third driving pulse starts after a lapse of a first preset time from start of the second driving pulse. The first preset time is equal to a value of about p×Tc, where a value of p is greater than 2 and Tc represents a Helmholtz characteristic vibration period for the liquid discharge head.

The third driving pulse starts after a lapse of the first preset time from the start of the second driving pulse. The first preset time is equal to the value of about p×Tc (where p is greater than 2). In other words, the third driving pulse starts at a time later than the start of the second driving pulse by a time interval longer than 2 Tc. If the third driving pulse starts at a time later than the start of the second driving pulse by a time interval equal to or shorter than 2 Tc, vibrations caused by discharge of the second droplet based on the second driving pulse are not sufficiently damped, so that changes in the discharge amount and discharge speed of droplets discharged from the nozzle are relatively large. When the third driving pulse starts at a time later than the start of the second driving pulse by a time interval longer than 2 Tc, vibrations caused by discharge of the second droplet based on the second driving pulse are suitably damped, so that changes in the discharge amount and discharge speed of droplets discharged from the nozzle are relatively small. Thus, if the timing of start of the third driving pulse is slightly advanced or delayed relative to the end of the first preset time (which is equal to the value of about p×Tc) due to the operating conditions of the liquid discharge device, the present preferred embodiment reduces changes in the discharge amount and discharge speed of droplets discharged from the nozzle. Consequently, droplets with desired sizes are discharged more stably than when the third driving pulse starts at a time later than the start of the second driving pulse by a time interval equal to or shorter than 2 Tc. The present preferred embodiment also provides a sufficient voltage margin for stable discharge not only when the liquid discharge device forms the second dot but also when the liquid discharge device forms the third dot.

Thus, preferred embodiments of the present invention provide liquid discharge devices that stably discharge droplets with desired sizes.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A liquid discharge device 20 according to a preferred embodiment of the present invention and an inkjet printer 10 including the liquid discharge device 20 will be described below with reference to the drawings. The preferred embodiments described herein are naturally not intended to limit the present invention in any way. Components and elements having the same functions are identified by the same reference signs, and description thereof will be simplified or omitted when deemed redundant.

Figure 1:
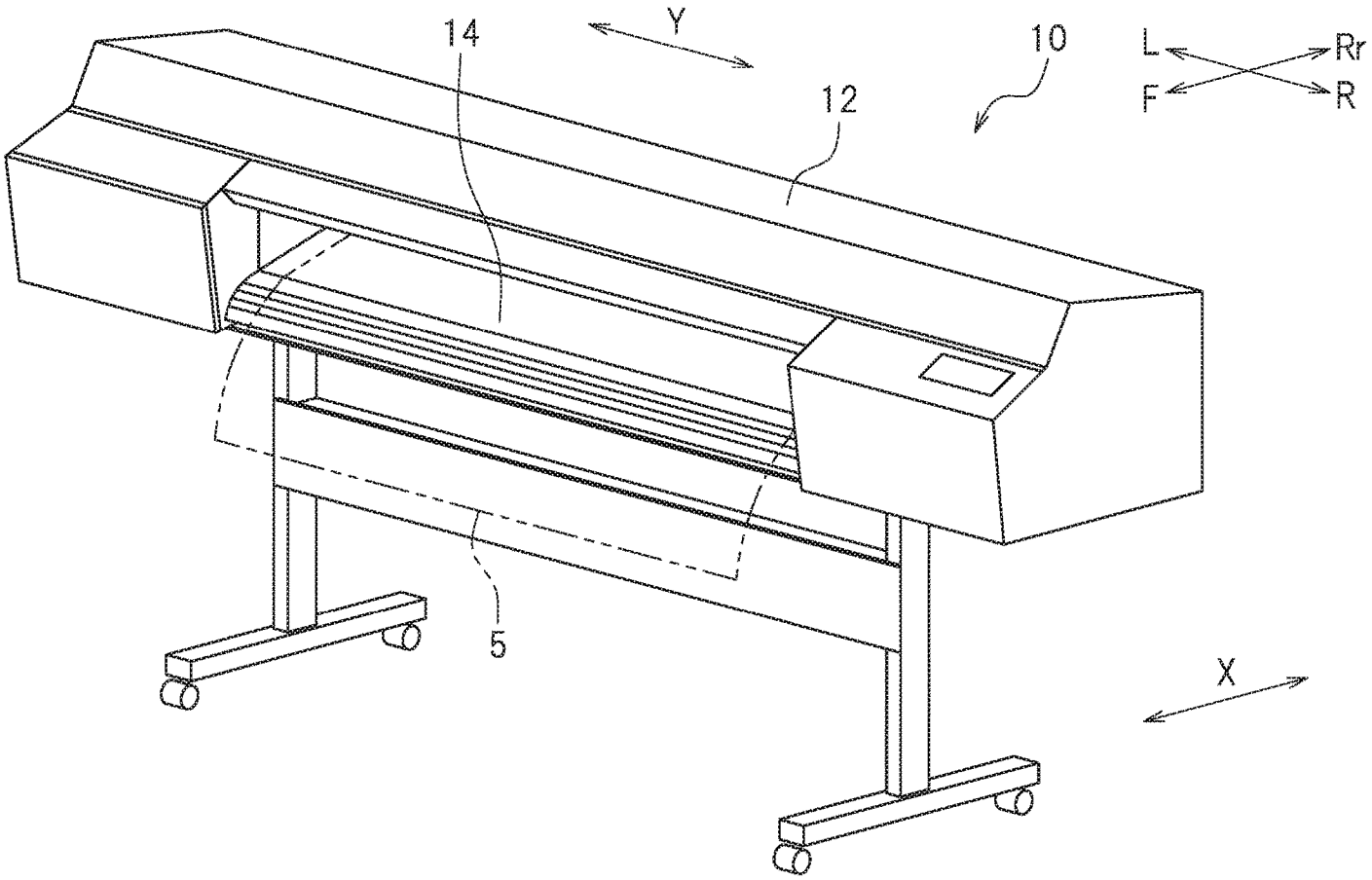
FIG. 1 is a perspective view of an inkjet printer according to a preferred embodiment of the present invention.
Figure 2:
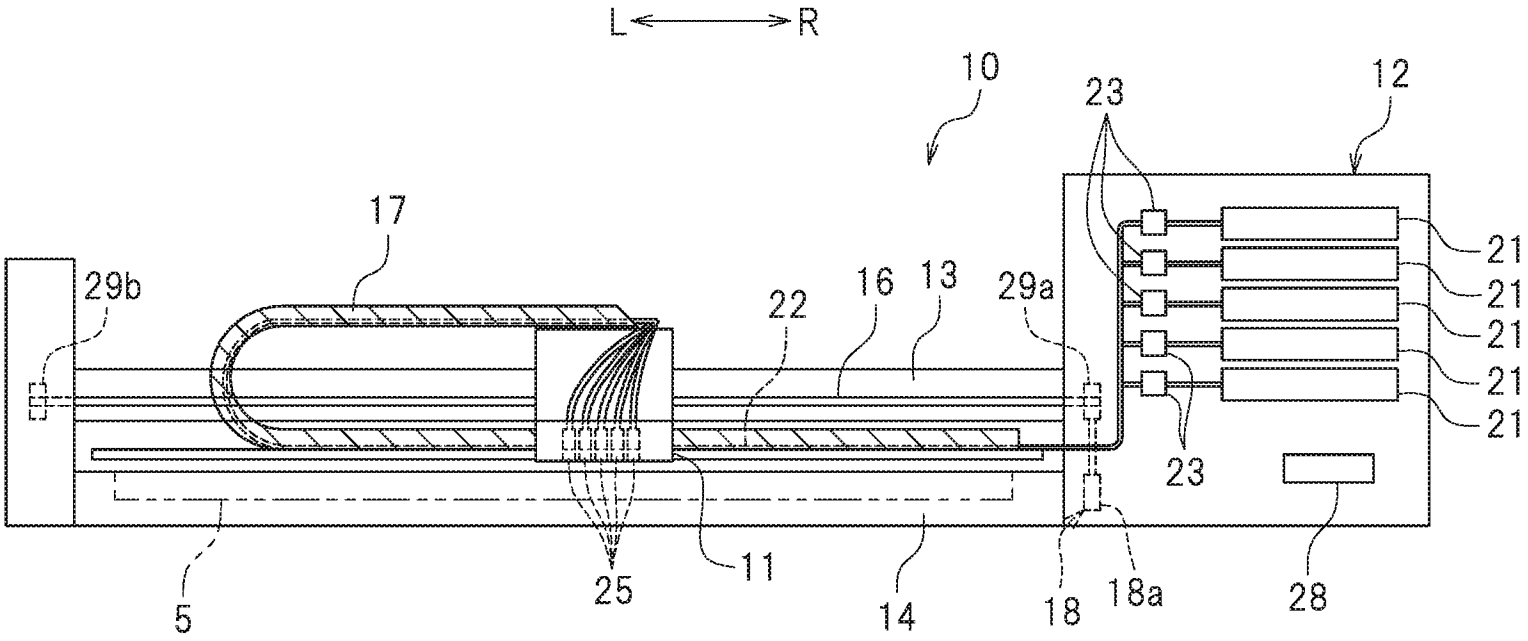
FIG. 2 is a front view of main components of an inkjet printer according to a preferred embodiment of the present invention.

FIG. 1 is a perspective view of the inkjet printer 10 according to the present preferred embodiment. The inkjet printer 10 will hereinafter be referred to as a "printer 10". FIG. 2 is a front view of main components of the printer 10. In FIGS. 1 and 2, the reference sign R represents right, and the reference sign L represents left. The reference sign F represents front, and the reference sign Rr represents rear. Discharge heads 25 (which will be described below) are movable rightward and leftward (see FIG. 2). Recording paper 5 is conveyable forward and rearward. In the present preferred embodiment, the direction of movement of the discharge heads 25 will be referred to as a "main scanning direction Y", and the direction of conveyance of the recording paper 5 will be referred to as a "sub-scanning direction X". The main scanning direction Y corresponds to a right-left direction. The sub-scanning direction X corresponds to a front-rear direction. The main scanning direction Y and the sub-scanning direction X are perpendicular to each other. These directions are defined merely for the sake of convenience of description and do not limit in any way how the printer 10 may be installed.

The printer 10 performs printing on the recording paper 5. The recording paper 5 is an example of a recording medium. The recording paper 5 is an example of a target onto which ink is to be discharged. Examples of a recording medium that may be used include not only paper, such as plain paper, but also resin materials, such as polyvinyl chloride (PVC) and polyester, and various other materials, such as aluminum, iron, and wood.

As illustrated in FIG. 2, the printer 10 includes a casing 12, and a guide rail 13 disposed in the casing 12. The guide rail 13 extends in the right-left direction (i.e., the main scanning direction Y). The guide rail 13 is in engagement with a carriage 11. The carriage 11 is provided with the discharge heads 25 to discharge ink. A carriage mover 18 moves the carriage 11 in a reciprocating manner along the guide rail 13 in the right-left direction. The carriage mover 18 includes: a pulley 29*a* disposed on the right end of the guide rail 13; and a pulley 29*b* disposed on the left end of the guide rail 13. A carriage motor 18*a* is coupled to the pulley 29*a*. Alternatively, the carriage motor 18*a* may be coupled to the pulley 29*b*. The pulley 29*a* is driven by the carriage motor 18*a*. An endless belt 16 is wound around the pulleys 29*a* and 29*b*. The carriage 11 is secured to the belt 16. Rotation of the pulleys 29*a* and 29*b* causes the belt 16 to run. The running of the belt 16 moves the carriage 11 in the right-left direction.

The printer 10 preferably is a wide-format inkjet printer, for example. This means that the printer 10 is larger than a desktop printer for home use, for example. From the viewpoint of increasing throughput, the scanning speed of the carriage 11 may be set to be relatively high, although consideration has to be given to a trade-off between throughput and resolution. In one example, the scanning speed may be set to be about 1300 mm/s to about 1400 mm/s at a driving frequency of about 16 kHz.

The recording paper 5 is conveyed in a paper feed direction by a paper feeder (not illustrated). In the present preferred embodiment, the paper feed direction is the front-rear direction (i.e., the sub-scanning direction X). A platen 14 is provided in the casing 12. The recording paper 5 is placed on the platen 14. The platen 14 is provided with a grit roller (not illustrated). A pinch roller (not illustrated) is provided above the grit roller. The grit roller is coupled to a feed motor (not illustrated). The grit roller is driven and rotated by the feed motor. With the recording paper 5 sandwiched between the grit roller and the pinch roller, rotation of the grit roller conveys the recording paper 5 in the front-rear direction.

The printer 10 includes a plurality of ink cartridges 21. The ink cartridges 21 store ink of different colors. In one example, the printer 10 includes five ink cartridges 21 storing ink of five different colors, such as cyan ink, magenta ink, yellow ink, black ink, and white ink.

The discharge heads 25 are each provided for ink of the associated color. Each discharge head 25 provided for ink of the associated color is connected to the associated ink cartridge 21 through an ink supply passage 22. The ink supply passage 22 is an ink flow passage through which the ink is supplied from each ink cartridge 21 to the associated discharge head 25. The ink supply passage 22 is a flexible tube, for example. The ink supply passage 22 is provided with liquid delivery pumps 23. The liquid delivery pumps 23 are not essential and may be omitted. A portion of the ink supply passage 22 is covered with a cable protection and guide device 17.

Figure 3:
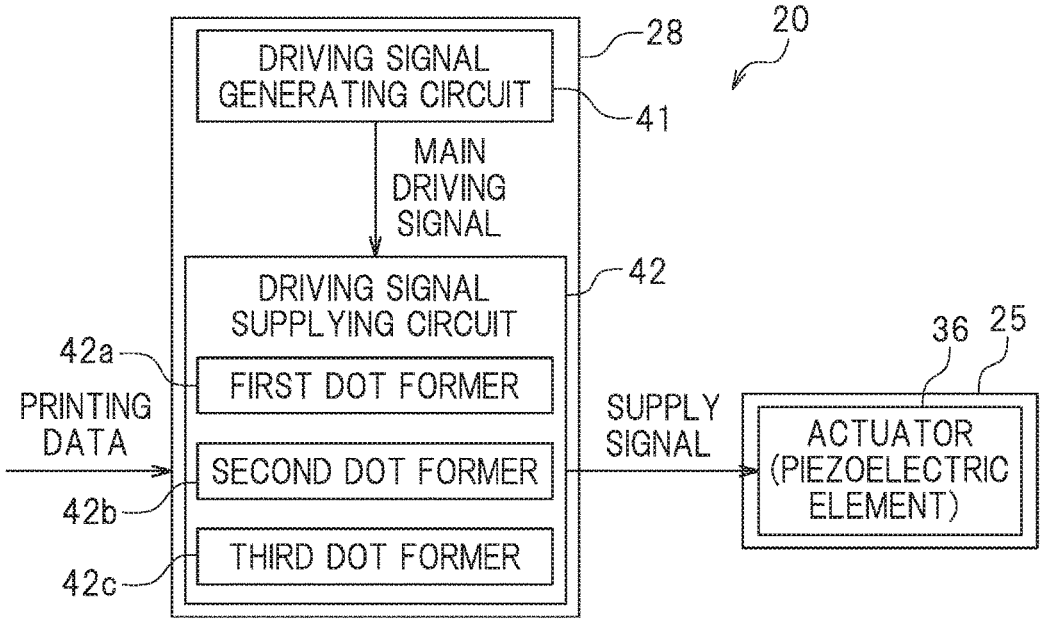
FIG. 3 is a block diagram illustrating a configuration of a liquid discharge device according to a preferred embodiment of the present invention.

As illustrated in FIG. 3, the printer 10 includes the liquid discharge device 20. The liquid discharge device 20 includes the discharge heads 25, and a controller 28 configured or programmed to control operations of the discharge heads 25.

Each discharge head 25 discharges a liquid (which is typically ink). Each discharge head 25 is an example of a liquid discharge head. Each discharge head 25 discharges ink onto the recording paper 5 so as to form ink dots on the recording paper 5. Arranging a large number of such dots forms, for example, an image on the recording paper 5. Each discharge head 25 includes a plurality of nozzles 35 (see FIG. 4) to discharge ink. The nozzles 35 are disposed on a surface of each discharge head 25 that faces the recording paper 5. In the present preferred embodiment, the nozzles 35 are disposed on the lower surface of each discharge head 25.

Figure 4:
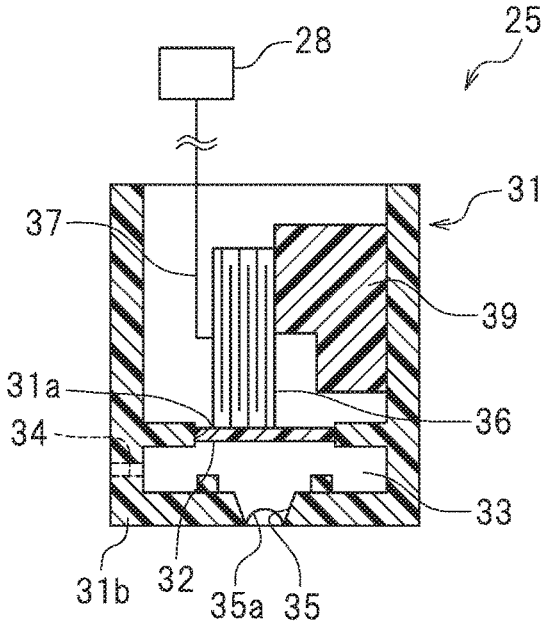
FIG. 4 is a partial cross-sectional view of a discharge head according to a preferred embodiment of the present invention.

FIG. 4 is a cross-sectional view of a portion of the discharge head 25 in the vicinity of one of the nozzles 35. Each discharge head 25 includes: a hollow case 31 including an opening 31*a*; and a defining plate 32 attached to the case 31 so as to close the opening 31*a*. The case 31 is provided with a pressure chamber 33 storing ink therein. The defining plate 32 defines a portion of the pressure chamber 33. The defining plate 32 is elastically deformable inward into the pressure chamber 33 and outward away from the pressure chamber 33. The defining plate 32 is deformable so as to increase and reduce the capacity of the pressure chamber 33. The defining plate 32 is typically a resin film.

A side wall of the case 31 is provided with an ink inlet 34 through which the ink flows into the pressure chamber 33. The ink inlet 34 may be located at any position as long as the ink inlet 34 is in communication with the pressure chamber 33. The ink is supplied to the pressure chamber 33 from the associated ink cartridge 21 through the ink inlet 34, so that a predetermined amount of the ink is temporarily stored in the pressure chamber 33. The nozzle 35 is provided in a lower surface 31*b* of the case 31. The nozzle 35 is in communication with the pressure chamber 33. The nozzle 35 discharges droplets (i.e., ink droplets) onto the recording paper 5. The liquid level (i.e., the free surface) of the ink in the nozzle 35 forms a meniscus 35*a*.

A Helmholtz characteristic vibration period Tc is set for the pressure chamber 33. The Helmholtz characteristic vibration period Tc is uniquely determined on the basis of, for example, the materials, sizes, shapes, and locations of components of the pressure chamber 33 (such as the case 31 and the defining plate 32), the area of opening of each nozzle 35, and properties (e.g., viscosity) of the ink. The Helmholtz characteristic vibration period Tc is a vibration period specific to each discharge head 25 during ink discharge. The Helmholtz characteristic vibration period Tc is, for example, a vibration period of a few or several microseconds to a few or several tens of microseconds. In one example, the Helmholtz characteristic vibration period Tc is a vibration period of about six microseconds. After ink droplets are discharged, residual vibration occurs in the pressure chamber 33 for the vibration period.

A piezoelectric element 36 is coupled to a surface of the defining plate 32 located opposite to the pressure chamber 33. A portion of the piezoelectric element 36 is secured to a securing member 39 provided on the case 31. The piezoelectric element 36 defines and functions as an actuator. The piezoelectric element 36 is connected to the controller 28 through a flexible cable 37. Through the flexible cable 37, an electric signal is supplied to the piezoelectric element 36. In the present preferred embodiment, the piezoelectric element 36 preferably is a multilayered structure in which piezoelectric materials and conductive layers are alternately stacked. Upon receiving an electric signal from the controller 28, the piezoelectric element 36 expands or contracts so as to cause the defining plate 32 to elastically deform inward into the pressure chamber 33 or outward away from the pressure chamber 33. In the present preferred embodiment, a longitudinal vibration mode piezoelectric element made of lead zirconate titanate (PZT) is used as the piezoelectric element 36. The piezoelectric element made of PZT will hereinafter be referred to as a "PZT piezoelectric element". The longitudinal vibration mode PZT piezoelectric element is expandable and contractible in a direction in which the piezoelectric materials and conductive layers are stacked. This direction will hereinafter be referred to as a "stacked direction". In one example, the PZT piezoelectric element contracts upon being discharged and expands upon being charged. The piezoelectric element 36 may be of any other type.

The piezoelectric element 36 of the discharge head 25 having the above-described structure contracts when the potential of the piezoelectric element 36 falls below its reference potential, for example. In accordance with the contraction of the piezoelectric element 36, the defining plate 32 elastically deforms outward away from the pressure chamber 33, i.e., from the initial position of the defining plate 32, resulting in expansion of the pressure chamber 33. As used herein, the term "expansion of the pressure chamber 33" refers to an increase in the capacity of the pressure chamber 33 caused by deformation of the defining plate 32. Then, an increase in the potential of the piezoelectric element 36 increases the length of the piezoelectric element 36 in the stacked direction. This causes the defining plate 32 to elastically deform into the pressure chamber 33, resulting in contraction of the pressure chamber 33. As used herein, the term "contraction of the pressure chamber 33" refers to a reduction in the capacity of the pressure chamber 33 caused by deformation of the defining plate 32. Such expansion and contraction of the pressure chamber 33 changes the pressure inside the pressure chamber 33. The change in the pressure inside the pressure chamber 33 pressurizes the ink in the pressure chamber 33, so that the ink is discharged in the form of ink droplets from the nozzle 35. Then, return of the potential of the piezoelectric element 36 to its reference potential moves the defining plate 32 to its initial position so as to allow the pressure chamber 33 to expand. This causes the ink to flow into the pressure chamber 33 through the ink inlet 34.

The controller 28 is communicably connected to: the carriage motor 18*a* of the carriage mover 18; the feed motor of the paper feeder; the liquid delivery pumps 23; and the discharge heads 25. The controller 28 is configured or programmed to control operations of these components. The controller 28 is preferably a computer, for example. The controller 28 includes: an interface (I/F) to receive, for example, printing data from an external device, such as a host computer; a central processing unit (CPU) to execute a command of a control program; a read-only memory (ROM) storing the program to be executed by the CPU; a random-access memory (RAM) to be used as a working area where the program is to be expanded; and a storage device, such as a memory, storing the program and various other types of data.

As illustrated in FIG. 3, the controller 28 is configured or programmed to include: a driving signal generating circuit 41 that generates a main driving signal to drive the discharge heads 25; and a driving signal supplying circuit 42 that supplies a portion or an entirety of the main driving signal, generated by the driving signal generating circuit 41, to the piezoelectric element 36 of each discharge head 25. In the following description, the piezoelectric element 36 of each discharge head 25 will be referred to as an "actuator 36". A signal supplied to the actuator 36 by the driving signal supplying circuit 42 will be referred to as a "supply signal". As will be described below in detail, the supply signal is a signal including a portion or an entirety of the main driving signal generated by the driving signal generating circuit 41.

The driving signal generating circuit 41 or the driving signal supplying circuit 42 is not limited to any particular hardware configuration. Because the driving signal generating circuit 41 and the driving signal supplying circuit 42 may each have a hardware configuration known in the art (e.g., a hardware configuration disclosed in JP 2014-162221 A), description thereof will be omitted.

The main driving signal generated by the driving signal generating circuit 41 includes a plurality of driving pulses. To be more specific, the main driving signal includes a first sub driving signal, a second sub driving signal, and a third sub driving signal. The first sub driving signal, the second sub driving signal, and the third sub driving signal each include at least one driving pulse. The driving signal supplying circuit 42 selects one or more of the first to third sub driving signals, and supplies the selected sub driving signal(s) to the actuator 36. Appropriately selecting the sub driving signal(s) to be supplied to the actuator 36 makes it possible to change the amount of ink to be discharged from the nozzle 35 of each discharge head 25 during a single driving period. This changes the size of each ink dot to be formed on the recording paper 5. The printer 10 according to the present preferred embodiment is able to form three types of dots having different sizes. The three types of dots include a first dot, a second dot, and a third dot. The first dot may hereinafter be referred to as a "small dot". The second dot may hereinafter be referred to as a "medium dot". The third dot may hereinafter be referred to as a "large dot". In one example, the small dot has an ink mass of about 8 ng to about 10 ng, the medium dot has an ink mass of about 12 ng to about 16 ng, and the large dot has an ink mass of about 20 ng to about 24 ng.

As illustrated in FIG. 3, the driving signal supplying circuit 42 includes a first dot former 42*a*, a second dot former 42*b*, and a third dot former 42*c*. In forming the first dot, the driving signal supplying circuit 42 functions as the first dot former 42*a* to supply the third sub driving signal to the actuator 36 without supplying the first sub driving signal or the second sub driving signal to the actuator 36. The first sub driving signal and the second sub driving signal are a portion of the main driving signal, and the third sub driving signal is the other portion of the main driving signal. In forming the second dot, the driving signal supplying circuit 42 functions as the second dot former 42*b* to supply the second sub driving signal and the third sub driving signal to the actuator 36 without supplying the first sub driving signal to the actuator 36. In forming the third dot, the driving signal supplying circuit 42 functions as the third dot former 42*c* to supply the first sub driving signal, the second sub driving signal, and the third sub driving signal to the actuator 36.

Figure 5:
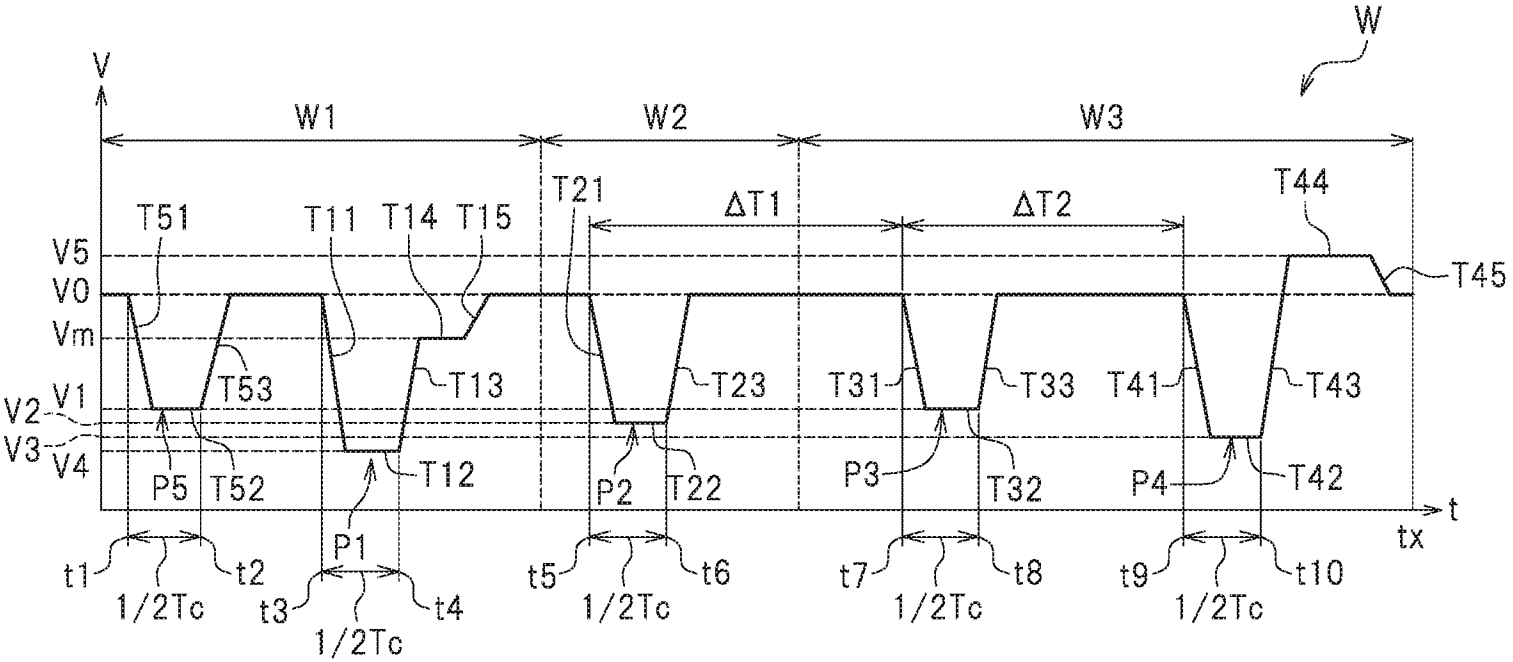
FIG. 5 is a waveform diagram of a main driving signal according to a preferred embodiment of the present invention.

FIG. 5 is a waveform diagram of a main driving signal W generated by the driving signal generating circuit 41. In FIG. 5, the horizontal axis t represents time, and the vertical axis V represents the potential of the actuator 36. The reference sign tx represents a single driving period. The driving signal generating circuit 41 preferably repeatedly generates, for each driving period, the main driving signal W illustrated in FIG. 5.

As illustrated in FIG. 5, the main driving signal W includes a first sub driving signal W1, a second sub driving signal W2, and a third sub driving signal W3. The third sub driving signal W3 is the rearmost portion of the main driving signal W. The second sub driving signal W2 follows the first sub driving signal W1. The third sub driving signal W3 follows the second sub driving signal W2.

The first sub driving signal W1 includes a first driving pulse P1 and a fifth driving pulse P5. The fifth driving pulse P5 precedes the first driving pulse P1. The fifth driving pulse P5 includes: a discharge waveform element T51 along which the potential of the actuator 36 falls to V1 from V0; a discharge maintaining waveform element T52 along which the potential of the actuator 36 is maintained at V1; and a charge waveform element T53 along which the potential of the actuator 36 increases to V0 from V1. The first driving pulse P1 includes: a discharge waveform element T11 along which the potential of the actuator 36 falls to V4 from V0; a discharge maintaining waveform element T12 along which the potential of the actuator 36 is maintained at V4; a charge waveform element T13 along which the potential of the actuator 36 increases to Vm from V4; a discharge maintaining waveform element T14 along which the potential of the actuator 36 is maintained at Vm; and a charge waveform element T15 along which the potential of the actuator 36 increases to V0 from Vm.

The second sub driving signal W2 includes a second driving pulse P2. The second driving pulse P2 includes: a discharge waveform element T21 along which the potential of the actuator 36 falls to V2 from V0; a discharge maintaining waveform element T22 along which the potential of the actuator 36 is maintained at V2; and a charge waveform element T23 along which the potential of the actuator 36 increases to V0 from V2.

The third sub driving signal W3 includes a third driving pulse P3 and a fourth driving pulse P4. The third driving pulse P3 precedes the fourth driving pulse P4. The third driving pulse P3 includes: a discharge waveform element T31 along which the potential of the actuator 36 falls to V1 from V0; a discharge maintaining waveform element T32 along which the potential of the actuator 36 is maintained at V1; and a charge waveform element T33 along which the potential of the actuator 36 increases to V0 from V1. The fourth driving pulse P4 includes: a discharge waveform element T41 along which the potential of the actuator 36 falls to V3 from V0; a discharge maintaining waveform element T42 along which the potential of the actuator 36 is maintained at V3; a charge waveform element T43 along which the potential of the actuator 36 increases to V5 from V3; a charge maintaining waveform element T44 along which the potential of the actuator 36 is maintained at V5; and a discharge waveform element T45 along which the potential of the actuator 36 falls to V0 from V5. In the present preferred embodiment, V5>V0>Vm>V1>V2>V3>V4. The relationship between the magnitudes of Vm, V1, V2, V3, and V4, however, is not limited to any particular relationship.

Each of the first to fifth driving pulses P1 to P5 is a driving pulse that temporarily increases and then reduces the capacity of the pressure chamber 33 (i.e., a driving pulse that causes the pressure chamber 33 to temporarily expand and then contract). In other words, each of the first to fifth driving pulses P1 to P5 is a driving pulse that temporarily depressurizes and then pressurizes the pressure chamber 33. The first to fifth driving pulses P1 to P5 respectively cause discharge of first to fifth droplets.

Figure 6:
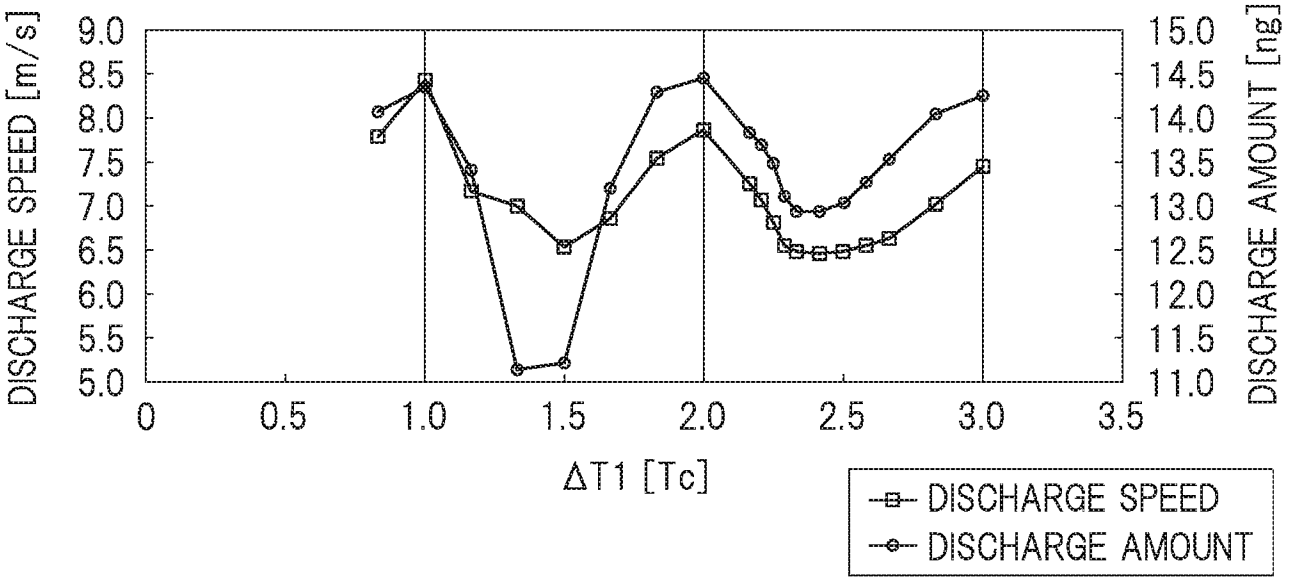
FIG. 6 is a graph illustrating the relationship between the timing of start of a third driving pulse and ink discharge amount and speed.

In the present preferred embodiment, the third driving pulse P3 starts after a lapse of preset time ΔT1 from the start of the second driving pulse P2. The preset time ΔT1 is equal to the value of about p×Tc (where p is greater than 2). As illustrated in FIG. 6, when 1Tc<ΔT1<2 Tc, the amount of discharge changes significantly relative to the change in Tc. Thus, when the preset time ΔT1 changes due to the operating conditions of the liquid discharge device 20 (e.g., when the timing of start of the third driving pulse P3 is advanced or delayed relative to the end of the preset time ΔT1 by about 0.5 μs to about 1 μs), the amount of discharge varies significantly. When ΔT1=1Tc or ΔT1=2 Tc, the amount of discharge assumes its maximum value, but it is difficult to allow a voltage margin for stable discharge. When 2 Tc<ΔT1, the change in the amount of discharge is relatively small relative to the change in Tc. Thus, variations in the amount of discharge are reduced in this case. In one example, the value of p is preferably greater than 2 and smaller than about 2.5. This reduces the overall waveform length of the main driving signal W so as to enable an increase in driving frequency, resulting in high speed printing. In another example, the value of p is preferably greater than about 2.25 and smaller than about 2.75. When about 2.25Tc<ΔT1<about 2.75Tc, the change in the amount of discharge is particularly small relative to the change in Tc. This further reduces variations in the amount of discharge if the preset time ΔT1 changes due to the operating conditions of the liquid discharge device 20. As used herein, the term "value of about p×Tc" does not necessarily refer to a value exactly identical to the theoretical value of the value of p×Tc but may refer to the value of p×Tc obtained when Tc fluctuates or has an error, for example. In one example, the "value of about p×Tc" may be between a value calculated by p×Tc−(1/6)×Tc and a value calculated by p×Tc+(1/6)×Tc, inclusive, where the value of about p×Tc is a theoretical value. The "value of about p×Tc" is preferably between a value calculated by p×Tc−(1/10)×Tc and a value calculated by p×Tc+(1/10)×Tc, inclusive, where the value of about p×Tc is a theoretical value. FIG. 6 is a graph illustrating the relationship between the amount of ink (i.e., the amount of discharge expressed in units of ng) and ink discharge speed (i.e., the discharge speed expressed in units of m/s). In the example illustrated in FIG. 6, a printer includes a discharge head for which the Helmholtz characteristic vibration period Tc is about 6 μs and forms the second dots (i.e., the medium dots) by discharging ink from the nozzle of the discharge head, with the time ΔT1 changed as follows: 0.83Tc, 1.00Tc, 1.17Tc, 1.33Tc, 1.50Tc, 1.67Tc, 1.83Tc, 2.00Tc, 2.17Tc, 2.21Tc, 2.25Tc, 2.29Tc, 2.33Tc, 2.42Tc, 2.50Tc, 2.58Tc, 2.67Tc, 2.83Tc, and 3.00Tc.

A potential variation ΔV2 (V0−V2) for the charge waveform element T23 of the second driving pulse P2 preferably is set to be equal to or greater than a potential variation ΔV3 (V0−V1) for the charge waveform element T33 of the third driving pulse P3. Thus, the speed of discharge of the third droplet is equal to or lower than the speed of discharge of the second droplet. In the present preferred embodiment, the variation ΔV2 and the variation ΔV3 are set such that (V0−V2)≈1.2(V0−V1), allowing the second droplet to be discharged at a speed about 1.2 times faster than the speed of discharge of the third droplet, for example. Although the value of (V0−V2) is not limited to any particular value, the value of (V0−V2) is preferably approximately equal to or less than twice the value of (V0−V1) from the viewpoint of reducing vibrations of the meniscus 35*a*.

In the present preferred embodiment, the discharge time (i.e., the sum of the time during which discharge is performed and the time during which discharge is maintained) of each of the first to fifth driving pulses P1 to P5 is set to be about one-half of the Helmholtz characteristic vibration period Tc for the discharge head 25. As illustrated in FIG. 5, when the start time of the discharge waveform element T51 is t1 and the end time of the discharge maintaining waveform element T52 is t2, t1 and t2 are set so as to satisfy Equation (1): t2−t1=(½)×Tc. When the start time of the discharge waveform element T11 is t3 and the end time of the discharge maintaining waveform element T12 is t4, t3 and t4 are set so as to satisfy Equation (2): t4−t3=(½)×Tc. When the start time of the discharge waveform element T21 is t5 and the end time of the discharge maintaining waveform element T22 is t6, t5 and t6 are set so as to satisfy Equation (3): t6−t5=(½)×Tc. When the start time of the discharge waveform element T31 is t7 and the end time of the discharge maintaining waveform element T32 is t8, t7 and t8 are set so as to satisfy Equation (4): t8−t7=(½)×Tc. When the start time of the discharge waveform element T41 is t9 and the end time of the discharge maintaining waveform element T42 is t10, t9 and t10 are set so as to satisfy Equation (5): t10−t9=(½)×Tc. Thus, the first to fifth driving pulses P1 to P5 are each set such that the expanded state of the pressure chamber 33 is maintained for a period of time represented by (½)×Tc.

Figure 7A:
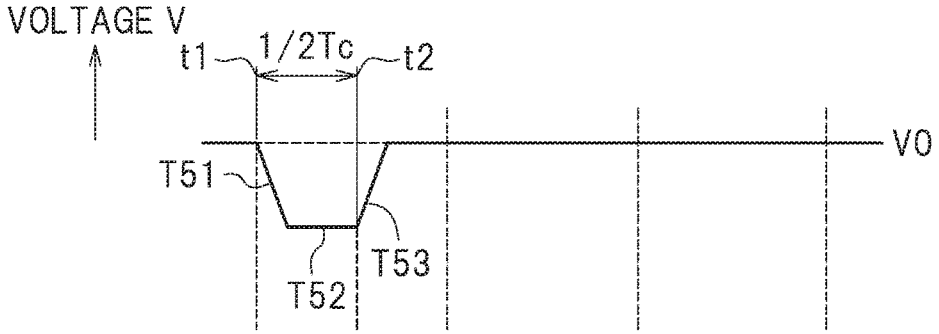
FIG. 7A is a schematic diagram illustrating a fifth driving pulse.
Figure 7B:
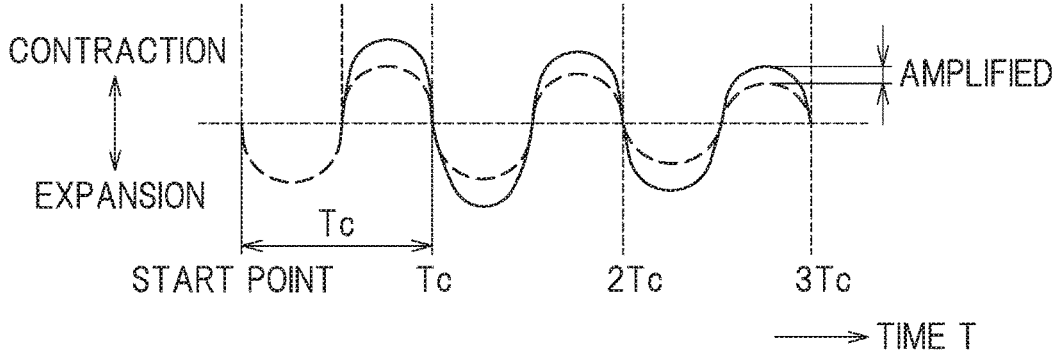
FIG. 7B is a schematic diagram illustrating the state of a pressure chamber associated with the fifth driving pulse illustrated in FIG. 7A.

As illustrated in FIG. 7A, a decrease in voltage value induced by discharging the actuator 36 causes contraction of the actuator 36, and an increase in voltage value induced by charging the actuator 36 causes extension of the actuator 36. The contraction of the actuator 36 results in expansion of the pressure chamber 33, and the extension of the actuator 36 results in contraction of the pressure chamber 33. Thus, t2−t1 in Equation (1), t4−t3 in Equation (2), t6−t5 in Equation (3), t8−t7 in Equation (4), and t10−t9 in Equation (5) each represent a period of time during which the expanded state of the pressure chamber 33 is maintained. The contraction of the actuator 36 induces Helmholtz characteristic vibrations of the pressure chamber 33 during the Helmholtz characteristic vibration period Tc as indicated by the broken line in FIG. 7B. Changing the actuator 36 from the contracted state to the extended state at a time when each of Equations (1) to (5) is satisfied enables an increase in the amplitude of the Helmholtz characteristic vibrations of the pressure chamber 33 as indicated by the solid line in FIG. 7B. Synchronizing the expansion and contraction of the pressure chamber 33 with the Helmholtz characteristic vibrations in this manner makes it possible to stabilize ink discharge and to discharge relatively large ink droplets at a smaller driving voltage. Consequently, large dots are accurately formed on the recording paper 5.

In the present preferred embodiment, the fourth driving pulse P4 starts after a lapse of a preset time ΔT2 from the start of the third driving pulse P3. The preset time ΔT2 is equal to the value of about n×Tc (where n is an integer equal to or greater than 2). In other words, the start of the fourth driving pulse P4 is simultaneous with the start of expansion of the pressure chamber 33 vibrating during the Helmholtz characteristic vibration period Tc. This prevents cancellation of vibrations of the pressure chamber 33 expanding during the Helmholtz characteristic vibration period Tc, resulting in improved discharge stability. Thus, reliably large dots are formed at predetermined positions on the recording paper 5. As used herein, the term "value of about n×Tc" does not necessarily refer to a value exactly identical to the theoretical value of the value of about n×Tc but may refer to the value of n×Tc obtained when Tc fluctuates or has an error, for example. In one example, the "value of about n×Tc" may be between a value calculated by n×Tc−(⅙)×Tc and a value calculated by n×Tc+(⅙)×Tc, inclusive, where the value of about n×Tc is a theoretical value. The "value of about n×Tc" is preferably between a value calculated by n×Tc−(1/10)×Tc and a value calculated by n×Tc+(1/10)×Tc, inclusive, where the value of n×Tc is a theoretical value.

Figure 7C:
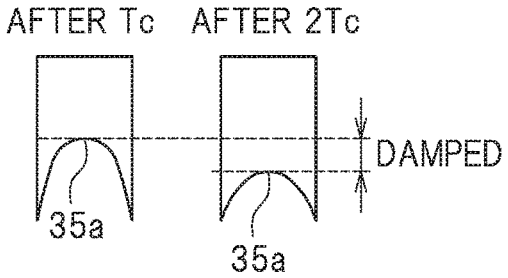
FIG. 7C is a schematic diagram illustrating the state of a meniscus adjacent to a nozzle.

The following description discusses the effects achieved when the fourth driving pulse P4 starts at a time later than the start of the third driving pulse P3 by a time interval equal to or longer than 2 Tc (i.e., when n≥2). A change in the pressure of the actuator 36 remains in the pressure chamber 33 after the third droplet is discharged. This causes the meniscus 35*a* to be significantly drawn toward the pressure chamber 33. A degree to which the meniscus 35*a* is drawn toward the pressure chamber 33 will hereinafter be referred to as a "degree of drawing". The meniscus 35*a* continuously returns to the opening of the nozzle 35 so as to reduce the degree of drawing little by little. Suppose that as illustrated in FIG. 7C, the fourth driving pulse P4 starts after the Helmholtz characteristic vibration period Tc during which the degree of drawing of the meniscus 35*a* is large. In such a case, a time interval between the end of discharge of the third droplet and the start of discharge of the fourth droplet is short. This results in a situation where the fourth droplet is discharged while the degree of drawing of the meniscus 35*a* toward the pressure chamber 33 is still large. Such a situation leads to a reduction in the amount of fourth droplet to be discharged. Such a situation also increases the resistance of a flow passage adjacent to the nozzle 35, so that the speed of satellite droplets is likely to decrease after the fourth droplet is discharged. As a result, mist is likely to occur.

When the fourth driving pulse P4 starts at a time later than the start of the third driving pulse P3 by a time interval equal to or longer than 2 Tc (i.e., when n≥2), the fourth droplet is discharged, with the meniscus 35*a* returned to the opening of the nozzle 35 to a predetermined degree. Thus, the amount of fourth droplet in this case is larger than when the fourth driving pulse P4 starts after a lapse of the period Tc from the start of the third driving pulse P3. Because the time interval between the third driving pulse P3 and the fourth driving pulse P4 increases, Helmholtz vibrations of the pressure chamber 33 expanded by the third driving pulse P3 will converge with time. This reduces the degree of contraction of the pressure chamber 33 so as to reduce the amount of ink passing through the nozzle 35 per unit time. As a result, the resistance of the flow passage adjacent to the nozzle 35 decreases, leading to an increase in the speed of satellite droplets. Consequently, the present preferred embodiment reduces or prevents occurrence of satellite droplets and mist, and enables stable discharge of the fourth droplet such that the discharge amount of fourth droplet is equal to or larger than the discharge amount of third droplet. When the printer 10 is a business-grade wide-format printer as illustrated in FIG. 1, for example, the value of n is generally 10 or less, typically 7 or less, preferably 5 or less, more preferably 3 or less, and particularly preferably 2.

In the present preferred embodiment, the speed of discharge of the fourth droplet caused by the fourth driving pulse P4 preferably is set to be equal to or higher than the speed of discharge of the third droplet caused by the third driving pulse P3. In other words, a potential variation (V5−V3) for the charge waveform element T43 of the fourth driving pulse P4 is set to be greater than a potential variation (V0−V1) for the charge waveform element T33 of the third driving pulse P3. This enables the third droplet and the fourth droplet to suitably merge before hitting onto the recording paper 5 (or while the droplets are flying off). This also more effectively prevents occurrence of long satellite droplets and mist.

Figure 8:
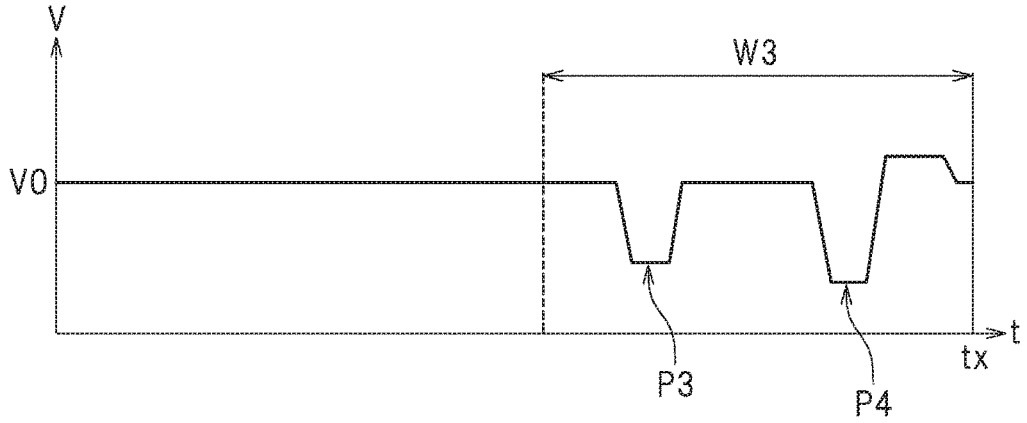
FIG. 8 is a waveform diagram of a supply signal to be supplied to form a small dot.

FIG. 8 illustrates the supply signal to be supplied to the actuator 36 for formation of the first dot (i.e., the small dot). Supplying the third driving pulse P3 to the actuator 36 temporarily increases and then reduces the capacity of the pressure chamber 33 so as to perform a third droplet discharging operation once. The third droplet discharging operation involves discharging the third droplet from the nozzle 35. Subsequently, supplying the fourth driving pulse P4 to the actuator 36 temporarily increases and then reduces the capacity of the pressure chamber 33 again so as to perform a fourth droplet discharging operation once. The fourth droplet discharging operation involves discharging the fourth droplet from the nozzle 35. Thus, supplying the third and fourth driving pulses P3 and P4 to the actuator 36 performs the third and fourth droplet discharging operations involving discharging the third and fourth droplets from the nozzle 35. The third droplet and the fourth droplet merge before hitting onto the recording paper 5.

Figure 9:
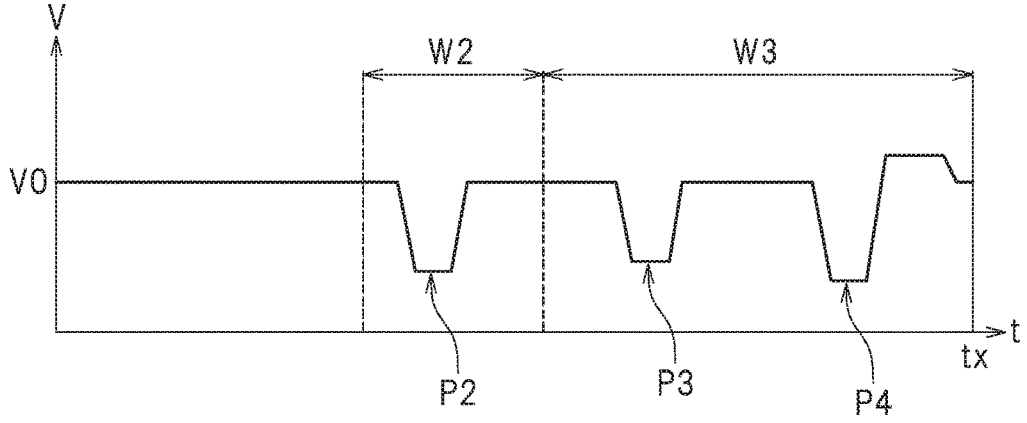
FIG. 9 is a waveform diagram of a supply signal to be supplied to form a medium dot.

FIG. 9 illustrates the supply signal to be supplied to the actuator 36 for formation of the second dot (i.e., the medium dot). Supplying the second driving pulse P2 to the actuator 36 temporarily increases and then reduces the capacity of the pressure chamber 33 so as to perform a second droplet discharging operation once. The second droplet discharging operation involves discharging the second droplet from the nozzle 35. Subsequently, supplying the third driving pulse P3 and the fourth driving pulse P4 to the actuator 36 temporarily increases and then reduces the capacity of the pressure chamber 33 again so as to perform each of the third and fourth droplet discharging operations once. The third droplet discharging operation involves discharging the third droplet from the nozzle 35, and the fourth droplet discharging operation involves discharging the fourth droplet from the nozzle 35. Thus, supplying the second to fourth driving pulses P2 to P4 to the actuator 36 performs the second to fourth droplet discharging operations involving discharging the second to fourth droplets from the nozzle 35. The second to fourth droplets merge before hitting onto the recording paper 5.

Figure 10:
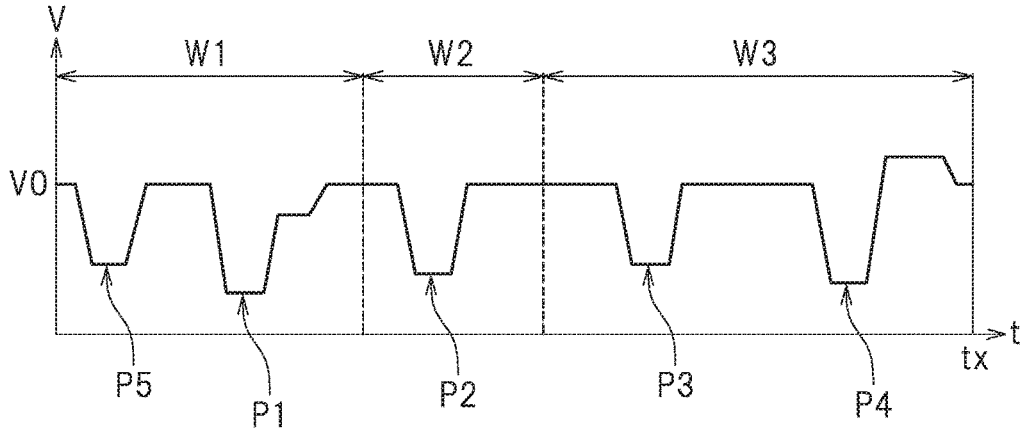
FIG. 10 is a waveform diagram of a supply signal to be supplied to form a large dot.

FIG. 10 illustrates the supply signal to be supplied to the actuator 36 for formation of the third dot (i.e., the large dot). Supplying the fifth driving pulse P5 to the actuator 36 temporarily increases and then reduces the capacity of the pressure chamber 33 so as to perform a fifth droplet discharging operation once. The fifth droplet discharging operation involves discharging the fifth droplet from the nozzle 35. Subsequently, supplying the first driving pulse P1 to the actuator 36 temporarily increases and then reduces the capacity of the pressure chamber 33 again so as to perform a first droplet discharging operation once. The first droplet discharging operation involves discharging the first droplet from the nozzle 35. Then, supplying the second driving pulse P2, the third driving pulse P3, and the fourth driving pulse P4 to the actuator 36 temporarily increases and then reduces the capacity of the pressure chamber 33 again so as to perform each of the second, third, and fourth droplet discharging operations once. The second droplet discharging operation involves discharging the second droplet from the nozzle 35, the third droplet discharging operation involves discharging the third droplet from the nozzle 35, and the fourth droplet discharging operation involves discharging the fourth droplet from the nozzle 35. Thus, supplying the first to fifth driving pulses P1 to P5 to the actuator 36 performs the first to fifth droplet discharging operations involving discharging the first to fifth droplets from the nozzle 35. The first to fifth droplets merge before hitting onto the recording paper 5.

Thus, when the printer 10 forms the second dot and the third dot, the third driving pulse P3 starts after a lapse of the preset time ΔT1 from the start of the second driving pulse P2. The preset time ΔT1 is equal to the value of about p×Tc (where p is greater than 2). Consequently, if the timing of start of the third driving pulse P3 is advanced or delayed relative to the end of the preset time ΔT1 due to the operating conditions of the liquid discharge device 20, the present preferred embodiment reduces or eliminates variations in ink discharge amount, resulting in stable discharge of the second dot and the third dot.

As described above, the liquid discharge device 20 according to the present preferred embodiment operates such that the third driving pulse P3 starts after a lapse of the preset time ΔT1 (which is equal to the value of about p×Tc, where p is greater than 2) from the start of the second driving pulse P2. In other words, the third driving pulse P3 starts at a time later than the start of the second driving pulse P2 by a time interval longer than 2 Tc. If the third driving pulse P3 starts at a time later than the start of the second driving pulse P2 by a time interval equal to or shorter than 2 Tc, vibrations caused by the discharge of the second droplet based on the second driving pulse P2 are not sufficiently damped, so that changes in the discharge amount and discharge speed of droplets discharged from the nozzle 35 are relatively large. When the third driving pulse P3 starts at a time later than the start of the second driving pulse P2 by a time interval longer than 2 Tc, vibrations caused by the discharge of the second droplet based on the second driving pulse P2 are suitably damped, so that changes in the discharge amount and discharge speed of droplets discharged from the nozzle 35 are relatively small. Thus, if the timing of start of the third driving pulse P3 is slightly advanced or delayed relative to the end of the preset time ΔT1 due to the operating conditions of the liquid discharge device 20, the present preferred embodiment reduces changes in the discharge amount and discharge speed of droplets discharged from the nozzle 35. Consequently, droplets with desired sizes (e.g., the second dot and the third dot in this case) are discharged more stably than when the third driving pulse P3 starts at a time later than the start of the second driving pulse P2 by a time interval equal to or shorter than 2 Tc.

The present preferred embodiment provides a sufficient voltage margin for stable discharge not only when the liquid discharge device 20 forms the second dot but also when the liquid discharge device 20 forms the third dot. More specifically, formation of the second dot involves starting the second driving pulse P2 before the third driving pulse P3, so that when ΔT1=p×Tc, where p is an integer equal to or greater than 1, the third droplet is accelerated by the second driving pulse P2, and the fourth droplet is accelerated by the accelerated third droplet. Thus, the speed of discharge of the fourth droplet in this case is higher than the speed of discharge of the fourth droplet for formation of the first dot. The smaller the value of p, the higher the acceleration of the third and fourth droplets. An increase in acceleration of the third and fourth droplets increases the discharge speed and the discharge amount, making it likely that meniscus overflow will occur, resulting in a reduction in voltage margin. Meniscus overflow may induce a defective condition, such as a situation where the droplets are discharged in an unintended direction. To prevent occurrence of such a defective condition, the value of ΔT1 is preferably increased as much as possible. The third driving pulse P3 more preferably starts at a time later than the start of the second driving pulse P2 by a time interval longer than 2 Tc in consideration of waveform length, because in such a case, vibrations caused by the second driving pulse P2 are suitably damped. The larger the discharge amount (i.e., the larger the number of driving pulses preceding the second driving pulse P2), the more likely it is that meniscus overflow will occur. To preclude meniscus overflow, the present preferred embodiment provides a larger voltage margin so as to enable stable discharge in forming the second dot. Consequently, the present preferred embodiment more effectively prevents occurrence of discharge instability in forming the third dot.

The liquid discharge device 20 according to the present preferred embodiment may be configured or programmed such that the value of p is greater than about 2 and smaller than about 2.5. This reduces the overall waveform length of the main driving signal W so as to enable an increase in driving frequency, resulting in high quality printing.

The liquid discharge device 20 according to the present preferred embodiment may be configured or programmed such that the value of p is greater than about 2.25 and smaller than about 2.75, for example. When about 2.25Tc<ΔT1<about 2.75Tc, the change in discharge amount is particularly small relative to the change in Tc. This further reduces variations in discharge amount if the preset time ΔT1 changes due to the operating conditions of the liquid discharge device 20.

In the liquid discharge device 20 according to the present preferred embodiment, ΔV2 ΔV3, where ΔV2 represents a potential variation for the second driving pulse P2 from an intermediate potential V0 to a second smallest potential V2, and ΔV3 represents a potential variation for the third driving pulse P3 from the intermediate potential V0 to a third smallest potential V1. Thus, the speed of discharge of the third droplet is equal to or higher than the speed of discharge of the second droplet. This provides a more favorable voltage margin for stable discharge not only when the liquid discharge device 20 forms the second dot but also when the liquid discharge device 20 forms the third dot.

The pressure chamber 33 preferably changes from the expanded state to the contracted state after a lapse of a predetermined time (equal to the value of about (½)×Tc) from the start of the third driving pulse P3 and after a lapse of the predetermined time (equal to the value of about (½)×Tc) from the start of the fourth driving pulse P4. Thus, the third driving pulse P3 and the fourth driving pulse P4 increase the amplitude of Helmholtz characteristic vibrations of the pressure chamber 33. This results in an improved droplet discharge stability and an increase in the degree of expansion and contraction of the pressure chamber 33, enabling discharge of larger droplets. The fourth driving pulse P4 preferably starts after a lapse of the preset time ΔT2 from the start of the third driving pulse P3. The preset time ΔT2 is equal to the value of about n×Tc (where n 2). This suitably reduces the degree of drawing of the meniscus 35*a* after discharge of the third droplet so as to stably discharge a large amount of the fourth droplet having a large size. The liquid discharge device 20 discharges the fourth droplet at a speed equal to or higher than a speed at which the liquid discharge device 20 discharges the third droplet. This causes the third droplet and the fourth droplet to merge appropriately. Because the discharge speed of the fourth droplet is increased, the present preferred embodiment reliably reduces or prevents occurrence of satellite droplets and mist The pressure chamber 33 preferably changes from the expanded state to the contracted state after a lapse of the predetermined time (equal to the value of about (½)×Tc) from the start of the first driving pulse P1. Thus, the first driving pulse P1 increases the amplitude of Helmholtz characteristic vibrations of the pressure chamber 33. This results in an improved droplet discharge stability and an increase in the degree of expansion and contraction of the pressure chamber 33, enabling discharge of the first droplet larger in size.

The pressure chamber 33 changes from the expanded state to the contracted state after a lapse of the predetermined time (equal to the value of about (½)×Tc) from the start of the second driving pulse P2. This enables discharge of the second droplet larger in size.

The pressure chamber 33 preferably changes from the expanded state to the contracted state after a lapse of the predetermined time (equal to the value of about (½)×Tc) from the start of the fifth driving pulse P5. This enables discharge of the fifth droplet larger in size.

Preferred embodiments of the present invention have been described thus far. The preferred embodiments described above are only illustrative, and the present invention may be embodied in various other forms.

In the foregoing preferred embodiments, the actuator 36 preferably is a longitudinal vibration mode piezoelectric element. The actuator 36, however, is not limited to a longitudinal vibration mode piezoelectric element. Alternatively, the actuator 36 may be a lateral vibration mode piezoelectric element. The actuator 36 is not limited to a piezoelectric element but may be a magnetostrictive element, for example.

In the foregoing preferred embodiments, the liquid preferably is ink. The liquid, however, is not limited to ink. The liquid to be discharged from the liquid discharge device 20 may be, for example, a resin material or any of various liquid composites (e.g., a cleaning liquid) containing a solute and a solvent.

In the foregoing preferred embodiments, the discharge heads 25 preferably are mounted on the printer 10. The discharge heads 25, however, may be mounted on any other device. The discharge heads 25 may be mounted on, for example, various inkjet production devices or a measuring instrument, such as a micropipette, and may find various applications.

In the foregoing preferred embodiments, the first sub driving signal W1 includes two driving pulses, the second sub driving signal W2 includes a single driving pulse, and the third sub driving signal W3 includes two driving pulses. The first sub driving signal W1, the second sub driving signal W2, and the third sub driving signal W3, however, may each include any other number of driving pulses. The first sub driving signal W1 may include a single driving pulse or three or more driving pulses. The second sub driving signal W2 may include two or more driving pulses. The third sub driving signal W3 may include a single driving pulse or three or more driving pulses.

In the foregoing preferred embodiments, the main driving signal W includes the first sub driving signal W1, the second sub driving signal W2, and the third sub driving signal W3. The main driving signal W, however, may include any other number of sub driving signals. The main driving signal W may include only two sub driving signals or four or more sub driving signals.

The terms and expressions used herein are for description only and are not to be interpreted in a limited sense. These terms and expressions should be recognized as not excluding any equivalents to the elements shown and described herein and as allowing any modification encompassed in the scope of the claims. The preferred embodiments of the present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A liquid discharge device comprising:

a liquid discharge head to discharge a liquid; and a controller configured or programmed to control the liquid discharge head; wherein the liquid discharge head includes:

a case provided with a pressure chamber storing the liquid therein;

a defining plate disposed in the case and defining a portion of the pressure chamber;

an actuator coupled to the defining plate and deforming in response to receiving an electric signal; and a nozzle disposed in the case and in communication with the pressure chamber;

the controller is configured or programmed to include:

a driving signal generating circuit to generate, for each driving period, a main driving signal including a first sub driving signal, a second sub driving signal, and a third sub driving signal, the first sub driving signal including a first driving pulse to cause the pressure chamber to expand and contract so as to discharge a first droplet, the second sub driving signal including a second driving pulse to cause the pressure chamber to expand and contract so as to discharge a second droplet, the third sub driving signal including a third driving pulse to cause the pressure chamber to expand and contract so as to discharge a third droplet, the third sub driving signal following the second sub driving signal; and a driving signal supplying circuit to supply, to the actuator, a portion or an entirety of the main driving signal generated by the driving signal generating circuit;

the driving signal supplying circuit includes:

a first dot former to supply the third sub driving signal to the actuator without supplying the first sub driving signal or the second sub driving signal to the actuator;

a second dot former to supply the second sub driving signal and the third sub driving signal to the actuator without supplying the first sub driving signal to the actuator; and a third dot former to supply the first sub driving signal, the second sub driving signal, and the third sub driving signal to the actuator; and the third driving pulse starts after a lapse of a first preset time from a start of the second driving pulse, the first preset time being equal to a value of about p×Tc, where a value of p is greater than about 2 and Tc is a Helmholtz characteristic vibration period for the liquid discharge head.

2. The liquid discharge device according to claim 1, wherein the value of p is greater than about 2 and smaller than about 2.5.

3. The liquid discharge device according to claim 1, wherein the value of p is greater than about 2.25 and smaller than about 2.75.

4. The liquid discharge device according to claim 1, wherein the first driving pulse includes a first potential decrease waveform along which a potential of the actuator decreases from an intermediate potential to a first smallest potential during a first time period;

the second driving pulse includes a second potential decrease waveform along which the potential of the actuator decreases from the intermediate potential to a second smallest potential during a second time period;

the third driving pulse includes a third potential decrease waveform along which the potential of the actuator decreases from the intermediate potential to a third smallest potential during a third time period; and $\Delta V2 \geq \Delta V3$, where $\Delta V2$ represents a potential variation for the second driving pulse from the intermediate potential to the second smallest potential, and $\Delta V3$ represents a potential variation for the third driving pulse from the intermediate potential to the third smallest potential.

5. The liquid discharge device according to claim 4, wherein the second driving pulse further includes:

a second smallest potential maintaining waveform along which the potential of the actuator is maintained at the second smallest potential for a predetermined period of time; and a second potential returning waveform along which the potential of the actuator increases from the second smallest potential to the intermediate potential: and the third driving pulse further includes:

a third smallest potential maintaining waveform along which the potential of the actuator is maintained at the third smallest potential for a predetermined period of time; and a third potential returning waveform along which the potential of the actuator increases from the third smallest potential to the intermediate potential.

6. The liquid discharge device according to claim 1, wherein the third sub driving signal further includes a fourth driving pulse to cause the pressure chamber to expand and contract so as to discharge a fourth droplet, the fourth driving pulse following the third driving pulse;

the third driving pulse maintains the expansion of the pressure chamber for a period of time equal to a value of about (½)×Tc;

the fourth driving pulse starts after a lapse of a second preset time from the start of the third driving pulse, the second preset time being equal to a value of about n×Tc, where n is an integer equal to or greater than 2;

the fourth driving pulse maintains the expansion of the pressure chamber for a period of time equal to the value of about (½)×Tc; and the fourth driving pulse causes the fourth droplet to be discharged at a speed equal to or higher than a speed at which the third droplet is discharged.

7. The liquid discharge device according to claim 1, wherein the first driving pulse maintains the expansion of the pressure chamber for a period of time equal to a value of about (½)×Tc.

8. The liquid discharge device according to claim 1, wherein the second driving pulse maintains the expansion of the pressure chamber for a period of time equal to a value of about (½)×Tc.

9. The liquid discharge device according to claim 1, wherein the first sub driving signal further includes a fifth driving pulse to cause the pressure chamber to expand and contract so as to discharge a fifth droplet; and the fifth driving pulse maintains the expansion of the pressure chamber for a period of time equal to a value of about (½)×Tc.

10. An inkjet printer comprising the liquid discharge device according to claim 1, wherein the liquid is ink.

* * * * *